US005818797A

United States Patent [19]

Watanabe et al.

[11] Patent Number: 5,818,797

[45] Date of Patent: Oct. 6, 1998

[54] TIME MEASURING DEVICE

[75] Inventors: Takamoto Watanabe, Nagoya; Hirofumi Isomura, Kariya, both of Japan

[73] Assignee: Denso Corporation, Kariya, Japan

[21] Appl. No.: 908,975

[22] Filed: Aug. 8, 1997

[30] Foreign Application Priority Data

Aug. 9, 1996 [JP] Japan ..... 8-211733

[51] Int. Cl.[6] ..... G04F 8/00; H03B 5/00

[52] U.S. Cl. ..... 368/113; 368/120; 331/57

[58] Field of Search ..... 368/113–120; 331/45, 57, 90; 377/20, 43

[56] References Cited

U.S. PATENT DOCUMENTS

| | | | |
|---|---|---|---|
| 5,128,624 | 7/1992 | Hoshino et al. . | |
| 5,134,371 | 7/1992 | Watanabe et al. . | |
| 5,416,444 | 5/1995 | Yamauchi et al. . | |
| 5,477,196 | 12/1995 | Yamauchi et al. . | |
| 5,684,760 | 11/1997 | Hunter | 368/120 |
| 5,694,377 | 12/1997 | Kushnick | 368/120 |

FOREIGN PATENT DOCUMENTS

| | | |
|---|---|---|
| 3-220814 | 9/1991 | Japan . |
| 5-37378 | 2/1993 | Japan . |

OTHER PUBLICATIONS

Ljuslin et al., "An Integrated 16–channel CMOS Time to Digital Converter", Oct. 1993, pp. 625–629, CERN, Geneva, Switzerland, XP 000481422.

Loinaz et al., "A CMOS Multichannel IC for Pulse Timing Measurements with 1–mV Sensitivity", IEEE Journal of Solid–State Circuits, Dec. 1995, pp. 1339–1348, vol. 30, No. 12, XP 000557238.

IEEE Journal of Solid State Circuits, vol. 30,No.12,Dec. 1995 A CMOS Multichannel IC for Pulse Timing Measurement with 1–MV Sensitivity, pp. 1339–1348.

*Primary Examiner*—Vit W. Miska

*Attorney, Agent, or Firm*—Cushman Darby & Cushman IP Group of Pillsbury Madison & Sutro LLP

[57] ABSTRACT

To provide a time measuring apparatus which is compact and capable of highly accurate measurements, on a semiconductor chip, flip-flops constituting a delayed-signal holding circuit of a first channel and flip-flops constituting a delayed-signal holding circuit of a second channel are disposed alternatingly and in a single row in a circuit region of the delayed-signal holding circuits to latch delayed signals from a pulse-circulating circuit, and flip-flops for latching the same delay signals are mutually adjacent. Due to this, distances between the pulse-circulating circuit and the respective delayed-signal holding circuits become equal, and delay signals having no deviation in delay due to difference in wiring length are supplied to the respective channels, and so uniform measurement can be performed between the respective channels.

17 Claims, 3 Drawing Sheets

(TO REGISTER)
16,26
S18
15,25
S10
S28
L28b
L10b
L10a
L28a
L18b
L18a
6
(i=1~9)
BFi
COUNTER
CO1~9
L20a
L20b
TCK
S20
BFc
AND
14
DE
9a
24
BF22
(MSB,CH1)
(MSB,CH2)
BF12
BFO
PA
PB2
PB1
BF11
BF21
GL
(TO REGISTER)
ENCODER (CH1)
ENCODER (CH2)
LOGIC CKT. (CH1,CH2)
F1f
F2f
F20
F10
PULSE CIRCULATOR
CH3, CH4 SIDE CIRCUIT
13
23
12,22
11,21
DY0~f
4
8c,8d

TIME MEASURING DEVICE

CROSS-REFERENCE TO RELATED APPLICATION

This application is related to Japanese Patent Application No. Hei 8-211733, incorporated herein by reference.

BACKGROUND OF THE INVENTION

1. Field of the Invention

The present invention relates to a time measuring device capable of measuring a minute time interval with a delay time of a delay element as its unit of resolution, and more particularly, to such a time measuring apparatus implemented in a semiconductor integrated circuit.

2. Description of Related Art

Japanese Patent Application Laid-Open Publication Nos. Hei 3-220814 and Hei 5-37378 disclose devices for detecting a phase difference (i.e., time interval) of two signals with a gate-delay time as a unit of resolution. These devices include a pulse phase difference encoding circuit for starting a pulse-circulating circuit including a plurality of delay elements directly connected in a ring configuration by applying a first pulse which is input at desired timing and causing pulse signals to be circulated. A counter circuit counts the number of circulations of the pulses. The devices specify a circulation position of a pulse signal circulating in the pulse-circulating circuit and a number of circulations counted in the counter circuit upon the input of a second pulse signal which is input with a phase difference from this first pulse, detect the phase difference (i.e., a time difference) between the first and second pulses based on the circulation position and number of circulations of the pulse, and encode this information as digital data. That is to say, these circuits have a single measurement channel to encode a single phase difference.

Accordingly, attempting to develop a device based on these circuits which has multiple measurement channels capable of concurrently encoding multiple phase differences gives rise to a problem in which circuit scale is enlarged when multiple circuits having a single measurement channel were simply lined up, and in turn layout area was enlarged on the semiconductor chip where semiconductor device integration was performed.

In contrast to this, a device having three measurement channels provided with only one PLL circuit with a built-in pulse-circulating circuit and made up of three signal-processing portions to latch and process an output signal of the pulse-circulating circuit built into this PLL circuit, along with layout on a semiconductor chip when this device has undergone semiconductor device integration, is disclosed in "A CMOS Multichannel IC for Pulse Timing Measurements with 1-mV Sensitivity" (IEEE Journal of Solid-State Circuits, vol. 30, No. 2, 2 Dec. 1995, pp 1339–1348).

However, with this device, three signal-processing portions are disposed on the semiconductor chip at asymmetrical positions with respect to the PLL circuit, and wiring length of a signal line to supply an output signal of the pulse-circulating circuit from the PLL circuit to the several signal-processing portions differs greatly for each, and so a time difference is produced between the signals input from the PLL circuit to the respective signal-processing portions, and as a result thereof, temporal nonuniformity occurs in each of the several bits of the signal latched at the signal-processing portion, and high-accuracy measurement cannot be performed.

SUMMARY OF THE INVENTION

In view of the above problems of the prior art, it is an object of the present invention to provide a time measuring apparatus which is compact and capable of highly accurate measurement operations.

Further, it is an object of the present invention to provide a time measuring apparatus having a counter circuit for counting a number of circulations in a pulse-circulating circuit and facilitating verification of operation of a circuit portion to determine an upper bit of a measurement value.

Other objects and features of the present invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

A preferred embodiment of the present invention will be described hereinafter with reference to the drawings.

Figure 1:
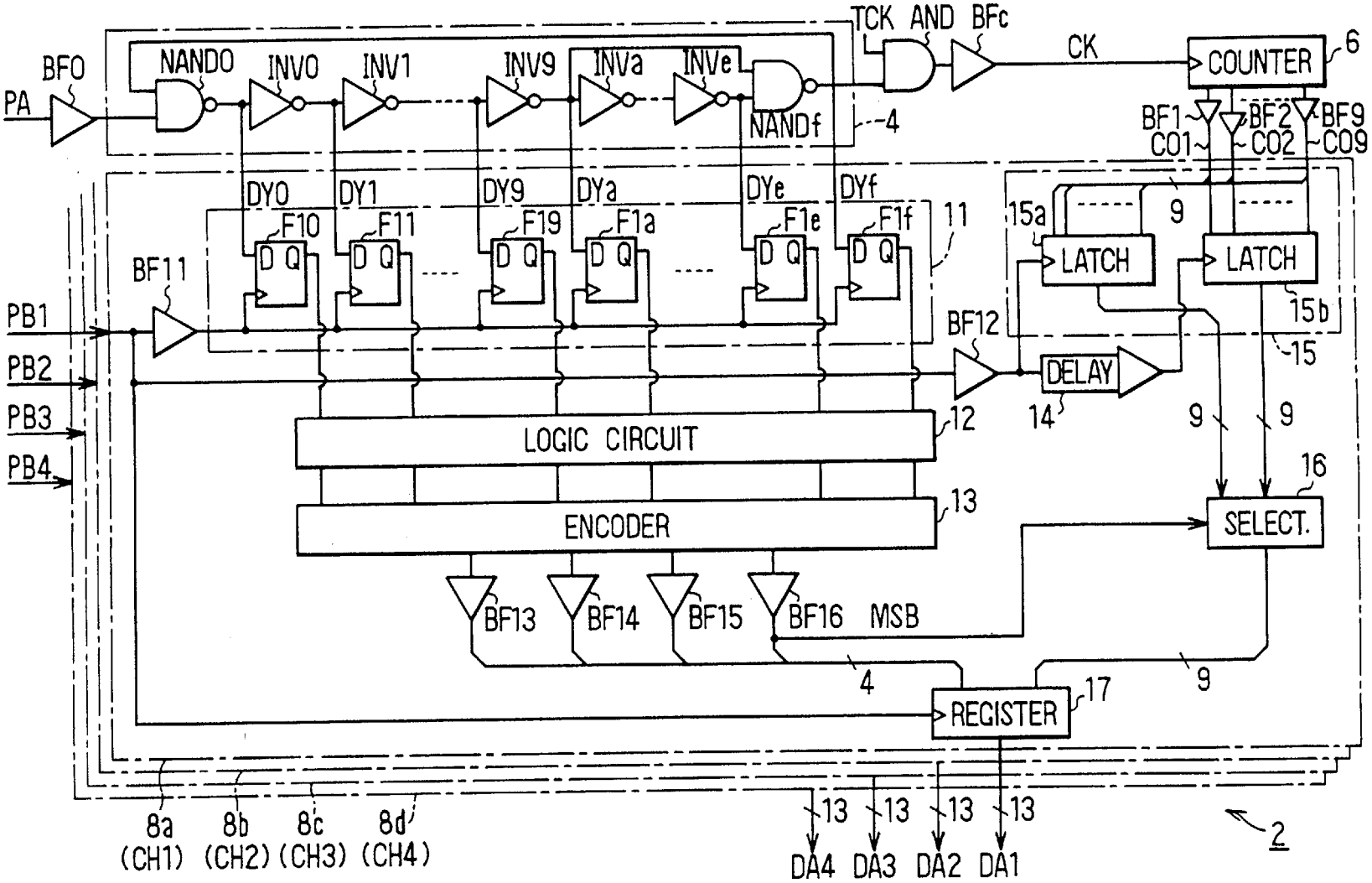
FIG. 1 is a schematic diagram showing the overall structure of a time measuring apparatus according to a preferred embodiment of the present invention.

FIG. 1 is a is a schematic diagram showing an overall structure of a time measuring apparatus according to the embodiment which measures a time interval from input of a measurement start signal PA until several measurement end signals PB1 through PB4 are input.

As shown in FIG. 1, time measuring device 2 according to the present invention is actuated by the measurement start signal PA, and is constituted by a pulse-circulating circuit 4 as a signal-delaying device to circulate a pulse signal, a 9-bit counter circuit 6 taking a circulating signal output upon each circulation of the pulse signal within the pulse-circulating circuit 4 as a count clock CK, delay signals DY0 through DY9 and DYa through DYf (hereinafter DY0 through DYf) output according to the circulation position of the pulse signal from the pulse-circulating circuit 4, and four signal-processing portions 8*a* through 8*d* to encode a phase difference (time interval) of the measurement start signal PA and the several measurement end signals PBi (where i=1 through 4) basis on count values C0 through C9 output from the counter circuit 6 to 13-bit digital data and output the same as a measured value DAi. Further, the signal-processing portions 8*a* through 8*d* hereinafter will be called channels CH1 through CH4, respectively.

Among these, the pulse-circulating circuit 4 is constituted by sequentially interconnecting in a ring configuration a total of 16 inverters made up of a two-input logical NAND circuit NAND0, 14 inverters INV1 through INV9 and INVa through INVe, and a two-input logical NAND circuit NANDf.

Accordingly, the measurement start signal PA is input from the outside to an input pin on the side of the logical NAND circuit NAND0 not connected to the logical NAND circuit NANDf via a buffer circuit BF0 for reducing parasitic capacitance, and further, an output signal of the inverter INV9 is input to an input pin on the side of the logical NAND circuit NANDf not connected to the inverter INVe.

With the pulse-circulating circuit 4 structured in this way, a mode of operation thereof is disclosed in detail in, for example, Japanese Patent Application Laid-Open No. Hei 6-216721 (incorporated herein by reference), and so detailed description thereof will be omitted, but in a case where the measurement start signal PA is at a low level, a high level is output from the inverter of the last stage (i.e., the logical NAND circuit NANDf) without the several inverters performing inversion, and conversely, when in a case where the measurement start signal PA is at high level, a clock signal taking a delay corresponding to the 16 inverters as one cycle is output from the last-stage inverter due to the several inverters performing an inverting operation.

This output signal of the last stage of the inverters (the logical NAND circuit NANDf) is input as a counter clock CK to a two-input logical AND circuit AND and the counter circuit 6 via a buffer circuit BFc for causing driving capacity of the signal to be enhanced. Further, an outside clock TCK is input to an input pin on a side of the logical AND circuit AND not connected to the logical NAND circuit NANDf. That is to say, the logical AND circuit AND supplies the counter circuit 6, as count clock CK, with output from the pulse-circulating circuit 4 when the outside clock TCK is taken to be high level or with the outside clock TCK when the measurement start signal PA is taken to be low level and the output from the pulse-circulating circuit 4 is taken to be high level.

Accordingly, the counter circuit 6 is made up of a synchronous counter of known art to vary en block values of respective digits according to input of the count clock CK, and performs counting at the rising edge of the count clock CK. Additionally, buffer circuits BF1 through BF9 for causing signal driving performance to be improved are respectively connected to nine signal lines for outputting count values CO1 through CO9 of the counter circuit 6.

Next, a signal-processing portion 8*a* is provided with a delayed-signal holding circuit 11 made up of DFF circuits F10 through F19 and F1*a* through F1*f* (hereinafter taken to be simply F10 through F1*f*) to respectively latch the outputs DY0 through DYf of the several inverters at rising-edge timing of a measurement end signal PB1, a logic circuit to specify a circulation position of a pulse signal circulating in the pulse-circulating circuit 4 and cause solely a signal line corresponding to the specified circulation position to go to high level on a basis of output signals from the several DFF circuits F10 through F1*f*, and an encoder 13 to encode 4-bit binary digital data according to output from the logic circuit 12.

Additionally, the signal-processing portion 8*a* is provided with a first latch circuit 15*a* to latch the count values CO1 through CO9 of the counter circuit 6 input via the buffer circuits BF1 through BF9 at rising-edge timing of the measurement end signal PB1, a delay line 14 to cause the measurement end signal PB1 to be delayed by a time of half-circulation of a pulse signal in the pulse-circulating circuit 4, a second latch circuit 15*b* to latch the count values CO1 through CO9 of the counter circuit 6 at rising-edge timing of a delay signal delayed by the delay line 14, a selector 16 to selectively output, on a basis of a most significant bit MSB of output from the encoder, the output of the first latch circuit 15*a* when MSB=0 or the output of the second latch circuit 15*b* when MSB=1, and a register 17 to hold a total of 13 bits of output from the encoder 13 and the selector 16 with rising edge timing of the measurement end signal PB1 and output the held value as a measured value DA1.

Further, the first latch circuit 15*a* and the second latch circuit 15*b* are collectively termed a circulation-number holding circuit 15. Accordingly, the first and second latch circuits 15*a* and 15*b* are constituted respectively by nine DFF circuits L10*a* through L18*a* and L10*b* through L18*b*.

Additionally, the measurement end signal PB1 is input via a buffer circuit BF11 to the several DFF circuits F10 through F1*f* of the delayed-signal holding circuit 11, and along with this, to be input via a buffer circuit BF12 to the first latch circuit 15*a* and the delay line 14. Additionally, output of the decoder 13 is input via respective buffer circuits BF13 through BF16 to the register 17. These buffer circuits BF11 through BF16 are provided for causing driving performance of signals to be improved (BF11 and BF12) and for causing parasitic capacitance of signal lines to be reduced (BF13 through BF16).

Moreover, the buffer circuit BF12 has a total delay time of the delay time at the buffer circuit BF11 and the delay time at the logical AND circuit AND and the buffer circuit BFc. Additionally, the delay line 14 is constituted by a multiplicity of buffer circuits such as these connected in series.

Next, structure with respect to signal-processing portions 8*b* through 8*d* is exactly the same as for the signal-processing portion 8*a*, and so description thereof will be omitted. However, in description hereinafter, in the internal structure of the several signal-processing portions 8*a* through 8*d*, the symbols of delayed-signal holding circuit i4, DFF circuits Fi0 through Fif, logic circuit i2, encoder i3, delay line i4, circulation-number holding circuit i5, selector i6, register i7, and buffer circuits BFi1 through BFi6 are caused to correspond to measurement end signal PBi (where i=1 through 4).

In the time measuring apparatus 2 structured in the above-described manner, when the outside clock TCK is held at high level and the measurement start signal PA rises, the pulse-circulating circuit 4 initiates circulating operation of pulse signals and causes pulse signals to be circulated while the measurement start signal PA is at high level, and the counter circuit 6 counts the number of circulations thereof.

Accordingly, for example when the measurement end signal PB1 rises, the several DFF circuits F10 through F1*f* of the delayed-signal holding circuit 11 latch the output of the several inverters of the pulse-circulating circuit 4, and along with this, the first latch circuit 15*a* latches the count values CO1 through CO9 of the counter circuit 6, and thereafter, after half the circulation time of the pulse signal has elapsed, the second latch circuit 15*b* again latches the count values CO1 through CO9 of the counter circuit 6.

When this occurs, the logic circuit 12 specifies a circulation position of the pulse signal on a basis of output of the delayed-signal holding circuit 11, and the encoder 13 generates 4-bit binary digital data corresponding to the circulation position specified by the logic circuit 12 and inputs the same to the register 17; meanwhile, the selector 16 inputs one or the other of the respective 9-bit count values held in the first latch circuit 15*a* or the second latch circuit 15*b* to the register according to the value of the most significant bit MSB of the output from the encoder 13.

Accordingly, when the next measurement end signal PB1 has been input, the register 17 holds a total of 13 bits of output from the encoder 13 and the selector 16, and outputs same as the measured value DA1.

Further, the reason why timing is shifted by a time of half of circulation time by the first latch circuit 15*a* and the second latch circuit 15*b* the count values of the counter circuit 6 are respectively latched, and either one or the other output is selected by the selector 16 on a basis of the most significant bit MSB of ED of the encoder 13 is to dependably fetch the count value of the counter circuit 6 in a state where the signal level thereof has been finalized.

In the foregoing manner, the time measuring apparatus 2 according to the present embodiment is provided with four signal-processing portions 8*a* through 8*d* (channels CH1 through CH4) in parallel, and the several measurement end signals PBi (where i=1 through 4) and measured values DAi are input to and output from the several signal-processing portions 8*a* through 8*d* by respective and individual signal lines.

Consequently, according to the time measuring apparatus 2 of the present embodiment, even when the measurement end signals PBi are generated to mutually overlap at mutually extremely proximate times, the measurement end signals PBi do not mutually interfere among one another with a plurality of measurement end signals PBi being recognized as a single signal; additionally, because the measured signals DAi thereof also are output with respective and individual signal lines, the measured values DAi of previously generated measurement end signals PBi are not overwritten by the measured values DAi of subsequently generated measurement end signals PBi, and as a result thereof, measurement of each of the several measurement end signals PBi can be reliably performed.

Additionally, according to the time measuring apparatus 2 of the present embodiment, the count value of the counter circuit 6 is latched with the timing of the measurement end signal PBi, and together with this, separately latches with timing caused to be delayed by a time of half the circulation time, selects the item latched at the time when the signal level of the count value of the counter circuit 6 is finalized according to the circulation position of the pulse signal, and utilizes this as data representing the number of circulations of the pulse signal, and so a measured value DAi of high reliability can be obtained.

Furthermore, the time measuring apparatus 2 of the present embodiment is such that either a clock signal from the pulse-circulating circuit 4 or the outside clock TCK can be selected as the counter clock CK, and when the outside clock TCK is selected, it is possible to cause operation with the counter circuit 6 and the upper-bit portion dissociated from the pulse-circulating circuit 4.

Consequently, according to the time measuring apparatus 2 of the present embodiment, operation verification of the counter circuit 6 and the upper-bit portion can be conducted easily and rapidly.

Additionally, in the time measuring apparatus 2 of the present embodiment, the measurement end signals PBi are supplied to the delayed-signal holding circuit i1 and circulation-number holding circuit i5 via the respective and individual buffer circuits BFi1 and BFi2, and moreover, the buffer circuit BFi2 on the circulation-number holding circuit i5 side is established so that the delay time in the buffer circuit BFi2 thereof becomes larger by an amount corresponding to the delay at the buffer circuit BFc and the logical AND circuit AND inserted in the signal line supplying the counter clock CK to the counter circuit 6 from the pulse-circulating circuit 4 in comparison with the buffer circuit BFi1 on the delayed-signal holding circuit i1 side.

Consequently, according to the time measuring apparatus 2 of the present embodiment, the delayed-signal holding circuit i1 and the circulation-number holding circuit i5 can be caused to operate substantially concurrently irrespectively of whether there exists a delay in an input signal from the counter circuit 6 to the circulation-number holding circuit i5 compared with an input signal from the pulse-circulating circuit 4 to the delayed-signal holding circuit i1, and reliability of the apparatus can be caused to be improved.

It may be noted in this regard that the above-described time measuring apparatus 2 according to the present embodiment is integrally formed on a semiconductor chip as a semiconductor integrated circuit.

Figure 2:
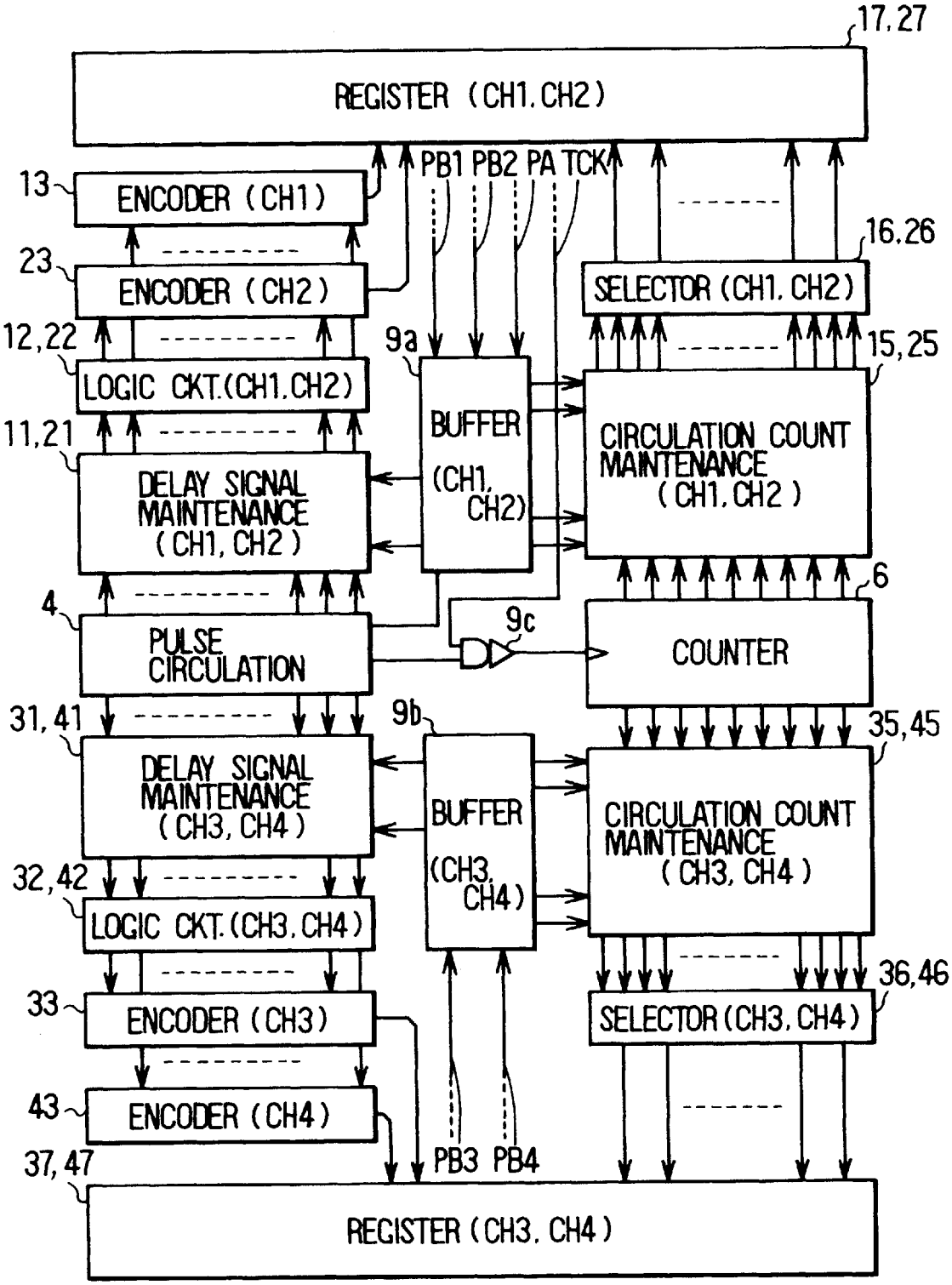
FIG. 2 is a block diagram showing the layout and connections on a semiconductor chip of portions of the time measuring device according to the embodiment.

Herein, FIG. 2 is a block diagram showing arrangement of circuit regions and an interconnected state among several circuit regions corresponding to several portions of the time measuring apparatus 2 on a semiconductor chip.

As shown in FIG. 2, firstly, the pulse-circulating circuit 4 is disposed in the central portion of a semiconductor chip with the inverters in a state of alignment in a single row. Hereinafter, to facilitate description, the direction of arrangement of the inverters, that is, the lengthwise direction of the circuit region of the pulse-circulating circuit 4, will be taken to be the horizontal-axis direction, and the direction perpendicular thereto will be taken to be the vertical-axis direction.

Accordingly, the delayed-signal holding circuits 11 and 21 of channels CH1 and CH2, the logic circuits 12 and 22 of channels CH1 and CH2, the encoder 23 of channel CH2, and the encoder 13 of channel CH1 (hereinafter collectively termed the lower-bit portion of channels CH1 and CH2) are disposed sequentially on one side along the vertical-axis direction of the pulse-circulating circuit 4, and the delayed-signal holding circuits 31 and 41 of channels CH3 and CH4, the logic circuits 32 and 42 of channels CH3 and 4, the encoder 33 of channel CH3, and the encoder 43 of channel CH4 (hereinafter collectively termed the lower-bit portion of channels CH3 and CH4) are disposed sequentially on the other side thereof to be bilaterally symmetrical around the axis of the circuit region of the pulse-circulating circuit 4.

Additionally, the counter circuit 6 is disposed at a position where the pulse-circulating circuit 4 extends in the horizontal-axis direction so that flip-flop circuits as basic elements to generate the several digits of the count value are aligned in the horizontal-axis direction.

Accordingly, the circulation-number holding circuits 15 and 25 of channels CH1 and CH2 and the selectors 16 and 26 of the channels CH1 and CH2 (hereinafter collectively termed the upper-bit portion of channels CH1 and 2) are disposed sequentially on one side along the vertical-axis direction of the pulse-circulating circuit 4, and the circulation-number holding circuits 35 and 45 of channels CH3 and CH4 and the selectors 36 and 46 of the channels CH3 and CH4 (hereinafter collectively termed the upper-bit portion of channels CH3 and 4) are disposed sequentially on the other side thereof to be axially symmetrical with the circuit region of the counter circuit 6 taken as the axis.

Further, the circuit regions of the several portions making up the lower-bit portions are in either case formed so that width along the horizontal-axis direction becomes substantially equal to that of the circuit region of the pulse-circulating circuit 4; the circuit regions of the several portions making up the upper-bit portions are in either case formed such that width along the horizontal-axis direction becomes substantially equal to the circuit region of the counter circuit 6.

Additionally, the registers 17 and 27 of channels CH1 and 2 are disposed on a still more outermost side in the vertical-axis direction of the lower-bit portion and the upper-bit portion of the channels CH1 and CH2, and the registers 37 and 47 of channels CH3 and CH4 are disposed on a still more outermost side in the vertical-axis direction of the lower-bit portion and the upper-bit portion of the channels CH3 and 4. Further, the circuit region of the registers 17 and 27 of channels CH1 and 2 is wide compared with the registers 37 and 47 of channels CH3 and 4 because the registers 27, 37, and 47 of the channels CH2 through 4 are able to hold measured data DA2 through DA4 for one round, and solely the register 17 of channel CH1 is able to hold measured data DA1 for two rounds.

Moreover, a buffer portion 9*a* (described later) of channels CH1 and CH2 is disposed between the lower-bit portion and the upper-bit portion of the channels CH1 and CH2, and a buffer portion 9*b* of channels CH3 and CH4 is disposed between the lower-bit portion and the upper-bit portion of the channels CH3 and CH4. Additionally, a buffer portion 9*c* made up of the logical AND circuit AND and the buffer circuit BFc is disposed between the pulse-circulating circuit 4 and the counter circuit 6.

Figure 3:
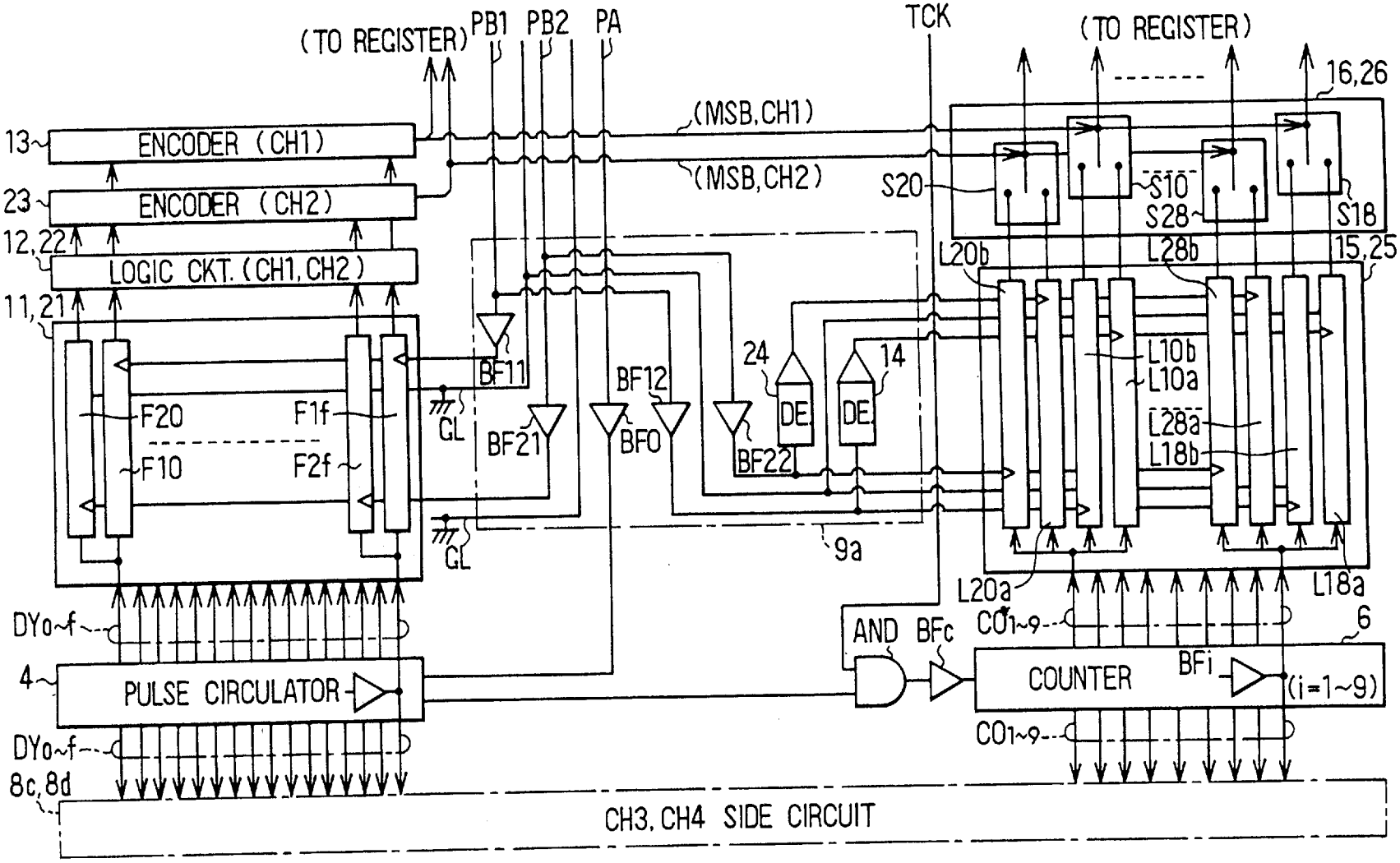
FIG. 3 shows the layout of circuitry in a portion of channels CH1 and CH2 of the embodiment.

FIG. 3 is an explanatory diagram showing the details of the delayed-signal holding circuits 11 and 21, circulation-number holding circuits 15 and 25, selectors 16 and 26, and buffer portion 9*c* of channels CH1 and CH2.

As shown in FIG. 3, the buffer portion 9*a* includes signal lines for conveying the measurement start signal PA and the measurement end signals PB1 and PB2, the buffer circuits BF0, BF11, BF12, BF21, and BF22, and the delay lines 14 and 24. Accordingly, the signal lines for conveying the measurement start signal PA and the measurement end signals PB1 and PB2 are wired to enter the buffer portion 9*a* from the side on which the registers 17 and 27 are disposed, and a shield line GL where electrical potential is fixed at ground potential is wired among the several signal lines.

Next, DFF circuits F10 through F1*f* constituting the delayed-signal holding circuit 11 of channel CH1 and DFF circuits F20 through F2*f* constituting the delayed-signal holding circuit 21 of channel CH2 are disposed alternately and in a single row in the circuit region of the delayed-signal holding circuits 11 and 12; that is to say, the DFF circuits F1*j* and F2*j* (where j=0 through f) for latching the output from the same inverter of the pulse-circulating circuit 4 are mutually adjacent.

Additionally, the circuit region of a single inverter and the circuit region of the pair of DFF circuits F1*j* and F2*j* to latch output from the same inverter are formed so that length along the horizontal-axis direction becomes equal, and as a result thereof, the overall circuit region of the pulse-circulating circuit 4 and the overall circuit region of the delayed-signal holding circuits 11 and 21 are such that the length along the horizontal-axis direction becomes equal.

Accordingly, besides the signal line to supply the measurement end signal PB1 to control operation of the DFF circuit F1*j*, a signal line to supply the measurement end signal PB2 which is unrelated to operation of the DFF circuit F1*j* and the shield line GL also are wired within the circuit region of the DFF circuit F1*j* to traverse the same along the horizontal-axis direction; similarly, besides the signal line for supplying the measurement end signal PB2 to control operation of the DFF circuit F2*j*, a signal line to supply the measurement end signal PB1 which is unrelated to operation of the DFF circuit F2*j* and the shield line GL also are wired in the circuit region of the DFF circuit F2*j* to traverse the same linearly in the shortest distance along the horizontal-axis direction.

Further, wiring such as was described above becomes possible because the semiconductor chip whereon the time measuring apparatus 2 according to the present embodiment is formed is of a multilayered structure, and it is possible to cause the signal lines to three-dimensionally intersect.

Next, the DFF circuits L1O*a* through L18*a* constituting the first latch circuit 15*a* of channel CH1, the DFF circuits L10*b* through L18*b* constituting the second latch circuit 15*b* thereof, the DFF circuits L20*a* through L28*a* constituting the first latch circuit 25*a* of channel CH2, and the DFF circuits L20*b* through L28*b* constituting the second latch circuit 25*b* are disposed one by one in sequence and in a single row in the circuit region of the circulation-number holding circuits 15 and 25; that is to say, the DFF circuits L1*ka*, L1*kb*, L2*ka*, and L2*kb* (where k=0 through 8) for latching the same digit of the count value of the counter circuit 6 are mutually adjacent.

Additionally, the circuit region of the flip-flop circuit for generating a single digit of the counter circuit 6 and the total circuit region of the four DFF circuits L1*ka*, L1*kb*, L2*ka*, and L2*kb* for latching the same digit of the counter circuit 6 are formed so that length along the horizontal-axis direction becomes equal, and as a result thereof, the overall circuit region of the counter circuit 6 and the overall circuit region of the circulation-number holding circuits 15 and 25 are such that length along the horizontal-axis direction becomes equal.

Accordingly, signal lines to convey the measurement end signals PB1 and PB2, signal lines to convey the delayed signals of the measurement end signals PB1 and PB2, and the shield line GL are wired in the circuit region of the circulation-number holding circuits 15 and 25, but within the circuit region of the respective DFF circuits Lika and Likb, besides the signal lines to convey signals to control operation of the DFF circuits Lika and Likb thereof, a signal line to supply a signal which is unrelated to operation of the DFF circuits Lika and Likb thereof and the shield line GL also are wired to traverse same linearly in the shortest distance along the horizontal-axis direction.

Next, the selectors 16 and 26 are constituted by nine switches S1*k* for selecting and outputting one or the other of the outputs of the DFF circuits L1*ka* and L1*kb* according to the most significant bit MSB of the output of the encoder 13, and nine switches S2*k* for selecting and outputting one or the other of the outputs of the DFF circuits L2*ka* and L2*kb* according to the most significant bit MSB of the output of the encoder 23. Accordingly, the circuit region of one pair of the DFF circuits Lika and Likb and the circuit region of the switches Sik corresponding thereto are mutually opposed, and additionally are formed so that length along the horizontal-axis direction becomes equal, and as a result thereof, are formed so that width of the overall circuit region of the selectors 16 and 26 and the of the overall circuit region of the circulation-number holding circuits 15 and 25 along the horizontal-axis direction becomes equal.

Herein, the circuit region on the channel CH3 and CH4 side differs with respect to the point that no signal line exists for supplying the outside clock TCK and the point that neither the signal line for the measurement start signal PA nor the buffer circuit BF0 exists in the buffer portion 9*b*; arrangement of other portions is completely identical to the circuit region of the channel CH1 and CH2 side.

The time measuring apparatus 2 of the present embodiment wherein circuit regions are disposed in the above-described manner is formed so that the circuit region of the single inverter constituting the pulse-circulating circuit 4 and the circuit region of the several pairs of DFF circuits F1*j* and F2*j* corresponding to the foregoing inverter become equal in width along the horizontal-axis direction, with the inverter and the corresponding DFF circuits being mutually opposed, and so among DFF circuits Fi0 through Fif constituting the same delayed-signal holding circuit i1, wiring lengths of the signal lines connecting the several inverters and the DFF circuits Fi0 through Fif corresponding respectively to the foregoing inverters can all be made to be uniform.

Additionally, the DFF circuits F1*j* and F2*j* latching the output from the same inverter of the pulse-circulating circuit 4 are mutually adjacent, and so even among these DFF circuits F1*j* and F2*j* (F3*j* and F4*j*) of differing channels, the wiring lengths of the signal lines connecting the intervals with the inverters corresponding to these can all be made to be uniform.

Similarly, the flip-flop circuits for generating the several digits of the count values CO1 through CO9 of the counter circuit 6, and the DFF circuits Lika and Likb (collectively termed Lik) constituting the circulation-number holding circuit i5 are disposed to have a relationship similar to the relationship of the inverter of the pulse-circulating circuit 4 and the DFF circuits Fij of the delayed-signal holding circuit i1, and so among the DFF circuits Li0 through Li8 constituting the same circulation-number holding circuit, the wiring lengths of the signal lines connecting the intervals with the several flip-flop circuits can be made to be uniform, along with which even among these DFF circuits L1*k* and L2*k* (L3*k* and L4*k*) of differing channels, the wiring lengths of the signal lines connecting the intervals with the inverters corresponding to these can all be made to be uniform.

Furthermore, the pulse-circulating circuit 4, the delayed-signal holding circuits 11 and 21 (31 and 41), the logic circuits 12 and 22 (32 and 42), and the encoders 13 and 23 (33 and 43) for generating lower-bit data, and the counter circuit 6, the circulation-number holding circuits 15 and 25 (35 and 45), and the selectors 16 and 26 (36 and 46) for generating upper-bit data are disposed to be aligned in a single row, and so the wiring lengths of the several signal lines connecting the circuit regions disposed in a row can be made to be short and uniform.

Moreover still, the circuit regions corresponding to channels CH1 and CH2 and the circuit regions corresponding to channels CH3 and CH4 are disposed axially symmetrically with the circuit regions of the pulse-circulating circuit 4 and the counter circuit 6 as the axes, the wiring lengths of the various signal lines of channels CH1 and CH2 and the wiring lengths of the respective signal lines of channels CH3 and CH4 can be made to be uniform.

In this way, in the time measuring apparatus 2 of the present embodiment, the several circuit regions constituting the apparatus are disposed so that the wiring lengths of the various signal lines connecting the several circuit regions become short and uniform, along with which the signal lines conveying the measurement end signals PBi are wired so that the several wiring lengths to the delayed-signal holding circuits i1 and the circulation-number holding circuits i5 become substantially equal, and moreover are wired so that the wiring lengths to the DFF circuits constituting these circuits i1 and i5 are of the shortest distance possible.

Consequently, according to the time measuring apparatus 2 of the present embodiment, the region required for the wiring of the various signal lines is suppressed to a minimum, and so circuit scale and in turn chip area of the semiconductor chip can be made to be compact, together with which the delay signals DY0 through DYf and the count values CO1 through CO9 of uniform timing with no deviations among the respective bits thereof are input via the signal lines of uniform wiring length to the delayed-signal holding circuits i1 and the circulation-number holding circuits i5, and the measurement end signals PBi of uniform timing are supplied to the respective DFF circuits latching these signals, and so highly accurate and stabilized measurement can be realized.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. An integrated circuit comprising:

signal delay means for receiving a starting signal at an input line thereof and, responsive to said starting signal, sequentially generating delay signals on a plurality of output lines thereof;

a plurality of signal holding means connected to said output lines to receive said delay signals, each of said signal holding means having an input line for receiving a respective ending signal and being for receiving delay signals from said signal delay means, holding said delay signals responsive to said respective ending signal, and providing said held signals at output lines thereof; and a plurality of output means each connected to said output lines of a respective one of said plurality of signal holding means, each of said output means being for receiving said held signals from said signal holding means and for providing a value representative of a time difference between said starting signal and said respective ending signal based on said held signals;

wherein said signal delay means includes a plurality of series-connected delay elements extending in a first direction in said integrated circuit;

each of said signal holding means includes a plurality of latches each corresponding to a respective one of said delay elements; and latches in different ones of said signal holding means corresponding to the same delay element are aligned with one another in a second direction perpendicular to said first direction.

2. The integrated circuit of claim 1, wherein each latch in at least one of said signal holding means is equidistant from the delay element to which it corresponds.

3. The integrated circuit of claim 1, wherein:

said input line of at least one of said signal holding means extends to each latch in said signal holding means to provide said respective ending signal thereto;

said plurality of latches of said at least one signal holding means include a first latch and a second latch more proximate to a point at which said signal holding means receives said respective ending signal; and said signal holding means input line extends to said first latch by passing through said second latch.

4. The integrated circuit of claim 1, wherein said plurality of signal holding means includes a first group of signal holding means disposed on a first side of said signal delay means and a second group of signal holding means disposed on a second side of said signal delay means opposite said first group of signal delay means and separated therefrom by an axis of said signal delay means extending in said first direction.

5. The integrated circuit of claim 1, further comprising a shield line, disposed between an input line of one of said plurality of signal holding means and another signal line in said circuit, for receiving a fixed electrical potential applied thereto.

6. The integrated circuit of claim 1, wherein each of said signal holding means is disposed between said signal delay means and a corresponding one of said output means.

7. The integrated circuit of any of claim 1 to claim 6, wherein:

said plurality of series-connected delay elements are connected in a loop for circulating a pulse signal therein responsive to said starting signal;

said integrated circuit further comprises a counter for receiving said circulated pulse signal from one of said delay elements, counting the number of times it is circulated through said loop and providing said count on output lines thereof, and a plurality of circulation holding means connected to said counter output lines for receiving said count, holding said count responsive to respective ones of said ending signals applied thereto, and providing said held count on output lines thereof;

each of said output means is further for receiving said held signals from a corresponding one of said signal holding means output lines and said held count from a corresponding one of said circulation holding means output lines and for generating said value based on said held signals as least significant timing information and said held count as most significant timing information;

said counter includes a plurality of counting elements extending in a third direction in said integrated circuit;

each of said circulation holding means includes a plurality of latches each corresponding to a respective one of said counting elements; and latches in different ones of said circulation holding means corresponding to the same counting element are aligned with one another in a fourth direction perpendicular to said third direction.

8. The integrated circuit of claim 7, wherein each latch in at least one of said circulation holding means is equidistant from the counting element to which it corresponds.

9. The integrated circuit of claim 7, wherein:

said input line of at least one of said circulation holding means extends to each latch in said circulation holding means to provide said respective ending signal thereto;

said plurality of latches of said at least one circulation holding means include a first latch and a second latch more proximate to a point at which said circulation holding means receives said respective ending signal; and said circulation holding means input line extends to said first latch by passing through said second latch.

10. The integrated circuit of claim 7, wherein said plurality of circulation holding means includes a first group of circulation holding means disposed on a first side of said counter and a second group of circulation holding means disposed on a second side of said counter opposite said first group of circulation delay means and separated therefrom by an axis of said counter extending in said third direction.

11. The integrated circuit of claim 7, wherein said first direction is identical to said third direction and said axis of said signal delay means is coincident with said axis of said counter.

12. The integrated circuit of claim 7, wherein:

said signal delay means and at least one of said signal holding means are disposed in a first portion of said integrated circuit;

said counter and at least a corresponding one of said circulation holding means are disposed in a second portion of said integrated circuit; and ending signal lines connected to input lines of said signal holding means and to input lines of said circulation holding means are disposed in a region of said integrated circuit between said first portion and said second portion to supply said ending signals thereto.

13. The integrated circuit of claim 12, wherein said signal holding means input lines and said circulation holding means input lines respectively connect to sides of respective ones of said signal holding means and said circulation holding means other than sides facing said signal delay means and said counter, respectively.

14. The integrated circuit of claim 7, wherein an input line of at least one of said signal holding means and said circulation holding means includes a buffer.

15. The integrated circuit of claim 7, wherein at least one output line of said counter includes a buffer.

16. The integrated circuit of claim 7, wherein:

at least one of said circulation holding means includes a first holding portion and a second holding portion each having a corresponding input line;

said at least one circulation holding means includes a delay element for delaying provision of a corresponding ending signal to said second holding portion by an amount of time corresponding to circulation of said pulse signal through half of said loop, and a selector, connected to said first and second holding portions and said signal delay means, for providing an output of one of said first and second holding portions as said value responsive to a position of said pulse signal in said loop; and said input lines of said signal delay means and said first holding means are directly connected to one another.

17. The integrated circuit of claim 7, further comprising selecting means for selectively providing one of said signal from said signal delay means and an external signal to said counter for use in counting circulations of said pulse signal.

* * * * *